US012650235B2

(12) United States Patent
Halfon

(10) Patent No.: US 12,650,235 B2
(45) Date of Patent: Jun. 9, 2026

(54) METHOD, SYSTEM, AND APPARATUS FOR CONTROLLING A PLURALITY OF PARAMETERS IN A NON-AIR-CONDITIONED CLOSED ENVIRONMENT

(71) Applicant: Erez Halfon, Cary, NC (US)

(72) Inventor: Erez Halfon, Cary, NC (US)

( * ) Notice: Subject to any disclaimer, the term of this patent is extended or adjusted under 35 U.S.C. 154(b) by 409 days.

(21) Appl. No.: 18/239,741

(22) Filed: Aug. 29, 2023

(65) Prior Publication Data

US 2025/0075924 A1 Mar. 6, 2025

Related U.S. Application Data

(60) Provisional application No. 63/415,958, filed on Oct. 13, 2022.

(51) Int. Cl.

| | |
|---|---|
| ***F24F 11/30*** | (2018.01) |
| ***F24F 5/00*** | (2006.01) |
| *F24F 110/10* | (2018.01) |
| *F24F 110/20* | (2018.01) |
| *F24F 110/40* | (2018.01) |
| *F24F 110/50* | (2018.01) |

(52) U.S. Cl.

CPC ..... *F24F 11/30* (2018.01); *F24F 5/0046* (2013.01); *F24F 2005/0064* (2013.01); *F24F 2110/10* (2018.01); *F24F 2110/20* (2018.01); *F24F 2110/40* (2018.01); *F24F 2110/50* (2018.01)

(58) Field of Classification Search

CPC .. F24F 11/30; F24F 5/0046; F24F 2005/0064; F24F 2110/10; F24F 2110/20; F24F 2110/40; F24F 2110/50; F24F 7/013; F24F 2110/72; F24F 11/0001; F24F 7/007; Y02B 30/70

See application file for complete search history.

(56) References Cited

U.S. PATENT DOCUMENTS

| | | | | |
|---|---|---|---|---|
| 5,082,173 | A * | 1/1992 | Poehlman | F24F 11/80 236/11 |
| 10,001,288 | B1 * | 6/2018 | Yang | F24F 11/79 |
| 2009/0124189 | A1 * | 5/2009 | Barber | F24F 11/0001 454/258 |
| 2012/0282561 | A1 * | 11/2012 | Kaiser | F24H 1/0027 432/92 |
| 2013/0199516 | A1 * | 8/2013 | Snyder | F24D 3/08 126/633 |

(Continued)

FOREIGN PATENT DOCUMENTS

| | | | | |
|---|---|---|---|---|
| RU | 2047502 | C1 * | 11/1995 | B60J 9/04 |

*Primary Examiner* — Alicia M. Choi

(74) *Attorney, Agent, or Firm* — Federico Fraccaroli

(57) ABSTRACT

This invention is particularly suitable to garage doors with predefined and standardized windows allowing an easy do-it-yourself installation. One aspect of the present invention relates to multi-panel retractable garage doors. A garage door ventilation assembly for a multi-panel retractable garage door that allows air, or poisonous gases, or humidity, to pass into and out of the interior of a garage according to predetermined or manual settings, while still providing a barrier to intruders, vapor, insects, debris and the like. While the invention has been described in reference to a garage door, its applicability is general and extends to any enclosed space.

20 Claims, 6 Drawing Sheets

(56) References Cited

U.S. PATENT DOCUMENTS

| | | | | |
|---|---|---|---|---|
| 2016/0193635 | A1* | 7/2016 | Mate | B23Q 11/0046<br>454/63 |
| 2016/0261425 | A1* | 9/2016 | Horton | H04L 67/535 |
| 2017/0030605 | A1* | 2/2017 | Heller | F24F 11/58 |
| 2019/0277522 | A1* | 9/2019 | Soyyigit | F24F 11/89 |
| 2020/0393152 | A1* | 12/2020 | Ramirez | F24F 11/80 |

* cited by examiner

METHOD, SYSTEM, AND APPARATUS FOR CONTROLLING A PLURALITY OF PARAMETERS IN A NON-AIR-CONDITIONED CLOSED ENVIRONMENT

CLAIM OF PRIORITY

This application claims priority to Provisional Application No. 63/415,958, titled Method, System, And Apparatus For Controlling A Plurality Of Parameters In A Non-Air-Conditioned Closed Environment, filed on Oct. 13, 2022, which is hereby incorporated by reference in its entirety.

BACKGROUND

Most garages are not air conditioned or heated and lack openings resulting in limited ventilation. As a result, the inside of the garage tends to become hot, particularly during warm weather months and cold during cold weather months.

It is a common discomfort for garage owners to walk into uncomfortable hot or polluted air. This is often caused by the lack of ventilation. Current solutions on the market are often either too large to be practical, or too expensive for the average homeowner. When all the options for garage-cooling are compared, none of the already-existing options are easy to install, nor are they cheap.

The interior of the garage can also accumulate automobile exhaust, which contains dangerous and cancer-causing particles. Moreover, CO, Carbon monoxide is a poisonous gas that can make a person seriously ill. Carbon monoxide can be made by fires and appliances that burn gas, wood, oil, or coal such as an electric generator that during winter and freezing temperatures could be operated from within a garage or in proximity of the garage. Furthermore, exhaust and odors from garbage when stored into the garage become stuck within a poorly ventilated garage and they can find their way into the house and create an unhygienic environment. Furthermore, in cold winter months, as garages are normally kept closed and many do not include windows, the interior of the garage typically remains dark and any humidity that accumulates can cause mold, fungus, and decay.

Sometimes, particularly in extreme cold weather conditions, to protect water pipes from freezing it is useful to heat the garage with a portable electric or gas heater but there is no system in place to ventilate the garage resulting in the building up of CO or poisonous gases.

Additionally, in severe weather conditions it is useful to run an electric generator. Normally, a generator cannot be run inside a garage because it produces poisonous exhaust gases. It would be useful to have a system that safely expels those poisonous gases when a generator is running inside the garage.

Many people have refrigerators and freezers in their garages. A hot garage causes these appliances to run for prolonged periods of time to maintain their constant temperatures, resulting in increased electric bills. Additionally, if the garage is adjacent to the house, the heat will transfer to the inside of the house, resulting in high electric bills.

In one approach for ventilating garages to overcome these problems, occupants typically leave the garage door semi-open. However, for security reasons, the garage door cannot be left open. Additionally, leaving the door open to the garage permits rubble, insects, rodents, and additional pests to enter.

Many garages door manufacturer offer the option to have windows in their multi-panel retractable garage doors. One example can be found at https://www.wayne-dalton.com/garage-doors. These windows are often standardized in Length, Width, and Height.

Consequently, a garage door ventilation assembly panel is needed that is affixed to the multi-panel retractable garage door to allow air to pass through while still providing a barrier to intruders, insects, and debris. The solution provided is also applicable to more general settings than a garage door.

SUMMARY OF THE PRESENT INVENTION

In one embodiment a ventilation assembly panel for a multi-panel retractable garage door is provided. The ventilation assembly panel includes a plurality of fans operably mounted to the multi-panel retractable garage door. The dimensions of the ventilation assembly panel can be standardized so that said ventilation assembly panel can be easily substituted with a window or a panel that constitutes said multi-panel retractable garage door. A plurality of sensors and electronic hardware is associated to said ventilation assembly panel and controls the operation of said fans.

BRIEF DESCRIPTION OF THE DRAWINGS

Various features of the present invention will be better understood from the following detailed description of an exemplary embodiments of the invention, taken in conjunction with the accompanying drawings in which like reference numerals refer to like parts.

DETAILED DESCRIPTION OF THE DRAWINGS

Figure 1:
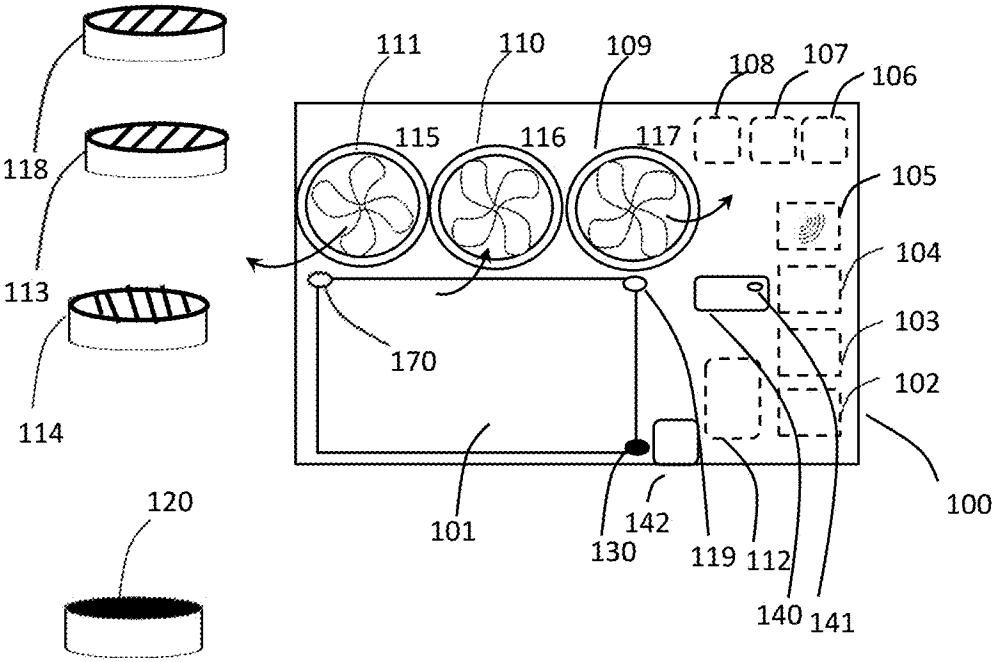
FIG. 1 illustrates a front view of a ventilation assembly panel, according to one embodiment of the present invention.

FIG. 1 illustrates a front view of a Standardized Ventilation Assembly Panel 100, according to one embodiment of the present invention; in this embodiment three fans are mounted on said ventilation assembly panel. The person skilled in the art will understand that this is just one example and more or fewer fans can be mounted on said Standardized Ventilation Assembly Panel 100.

In one embodiment, Fan 115 and Fan 117 can be dedicated to extract air from the inside of the garage. In one embodiment, Fan 116 can be dedicated to sucking air into the garage from the outside. In one embodiment, Fans 115, 116 And 117 will rotate only in one direction, clockwise or anticlockwise. In another embodiment, Fans 115, 116, 117 will rotate in both directions clockwise and anticlockwise, according to needs. In one embodiment, Solar Panel 101 will be affixed on the Standardized Ventilation Assembly Panel 100 and said Solar Panel 101 can be fixed or it can be adjustable by means of Lever 130 And Hinge 119, to be exposed to the light of the sun at an optimal angle. In one embodiment, Standardized Ventilation Assembly Panel 100 will incorporate a Battery 102.

In some implementations, a Motorized Lever 170 can regulate the angle at which Solar Panel 101 is inclined to optimize power harvesting or to protect the panel from inclement weather. In some implementations, said Motorized Lever will move automatically when a rain sensor detects rain. In some implementations, Solar Panel 101 will completely cover Standardized Ventilation Assembly Panel 100, leaving only a gap for the fans to function by extracting air from the enclosed space and/or sucking air into the enclosed space from outside.

Said Battery 102 can be used to store the energy produced by Said Solar Panel 101 or other energy sources. In some implementations, CPU 103 will be used to run different algorithms to supervise the various functionalities of said Standardized Ventilation Assembly Panel 100. Memory 104 may store instructions and algorithms to operate said Standardized Ventilation Assembly Panel 100 and its sensors and functionalities. In one implementation, a Wireless Module 105, will operate according to one or more wireless standard such as, e.g., 802.11b/g/n (2.4 GHz), 5G, and 802.11a/n (5 GHz) to allow connectivity with Smartphone 230, Sensors 511, 510, 509, 508, 507, 506, 512, 513, 514 or devices coupled to Standardized Ventilation Assembly Panel 100, such, e.g., as Electric Generator 505.

In one implementation, CO & Smoke Sensor 106 is affixed inside the Standardized Ventilation Assembly Panel 100. In one implementation. Temperature Sensor 107 is affixed inside the Standardized Ventilation Assembly Panel 100. In one implementation, Humidity Sensor 108 is affixed inside the Standardized Ventilation Assembly Panel 100. In one implementation, Humidity Sensor 108 is affixed inside the Standardized Ventilation Assembly Panel 100. In one implementation, Input/Output Module 112 is affixed inside the Standardized Ventilation Assembly Panel 100. Said Input/Output Module 112 may consist in a display that is capable of displaying warnings, useful information, and assist in programming the device. In other implementations it may consist in a touch display. In some implementations the display may be placed on both sides of the Standardized Ventilation Assembly Panel 100. In other implementations said Input/Output Module 112 is placed only on one side of the Standardized Ventilation Assembly Panel 100.

The person skilled in the art will understand that in some embodiments. Fans 115, 116, and 117 could be close enough such that Fan 115 and Fan 117 that can be dedicated to extract air from the inside of the garage and Fan 116 that can be dedicated to sucking air into the garage from the outside may interfere with each other's operation. For example, the air that is extracted by Fan 115 and 117 could immediately be sucked in by Fan 116. Air ducts 118, 113, and 114 having obliquus grates are capable of deflecting the flux of air that is extracted or sucked into the garage. In one implementation they can be secured at Rims 111, 110, 109 and positioned, for example Fan 117 extracts air to the right and Fan 115 extracts air to the left.

Carbon Monoxide is measured in Parts per Million (PPM) from 1 to 70. An average CO measurement in a home is about 0.5 to 5 ppm while it could increase to 15 ppm with a gas stove. If a Carbon Monoxide sensor in an enclosed space such as a garage is showing 30 PPM, the system may alert an homeowner to turn on the ventilation in some rooms that are closer, e.g., to the garage door (i.e. Kitchen, living room, 1st floor) to prevent the CO in the garage or more generally the enclosed space, from reaching the inside of the home.

An application on a smart phone may send a text or produce a beep, alerting of a high CO level reported in the enclosed space, giving a homeowner the option to turn on the system remotely.

In a remote application, the sensors could be connected to the home/property WIFI or via a cellular sim card to notify of the comparison between the enclosed space served by the Standardized Ventilation Assembly Panel 100 and a nearby home. In a farming application, the system may measure ambient parameters, CO, and other gases to protect the life of the chickens, pigs, or other livestock.

In one implementation an Integrated Camera 142 may ensure that a garage door or any other door where the system is mounted is closed. Camera 142 may also detect intruders. In one implementation, Camera 142 can be a two-way camera, facing both the inside the enclosed space and also outdoor.

In some implementations when useful, Rim 111, 110, 109 can host a cover such as cover 120 to block completely the air from entering or exiting the garage.

In one implementation a Light 140 can be placed on Standardized Ventilation Assembly Panel 100 and can be activated via a Motion Sensor 141 and Powered by Battery 102.

Figure 2:
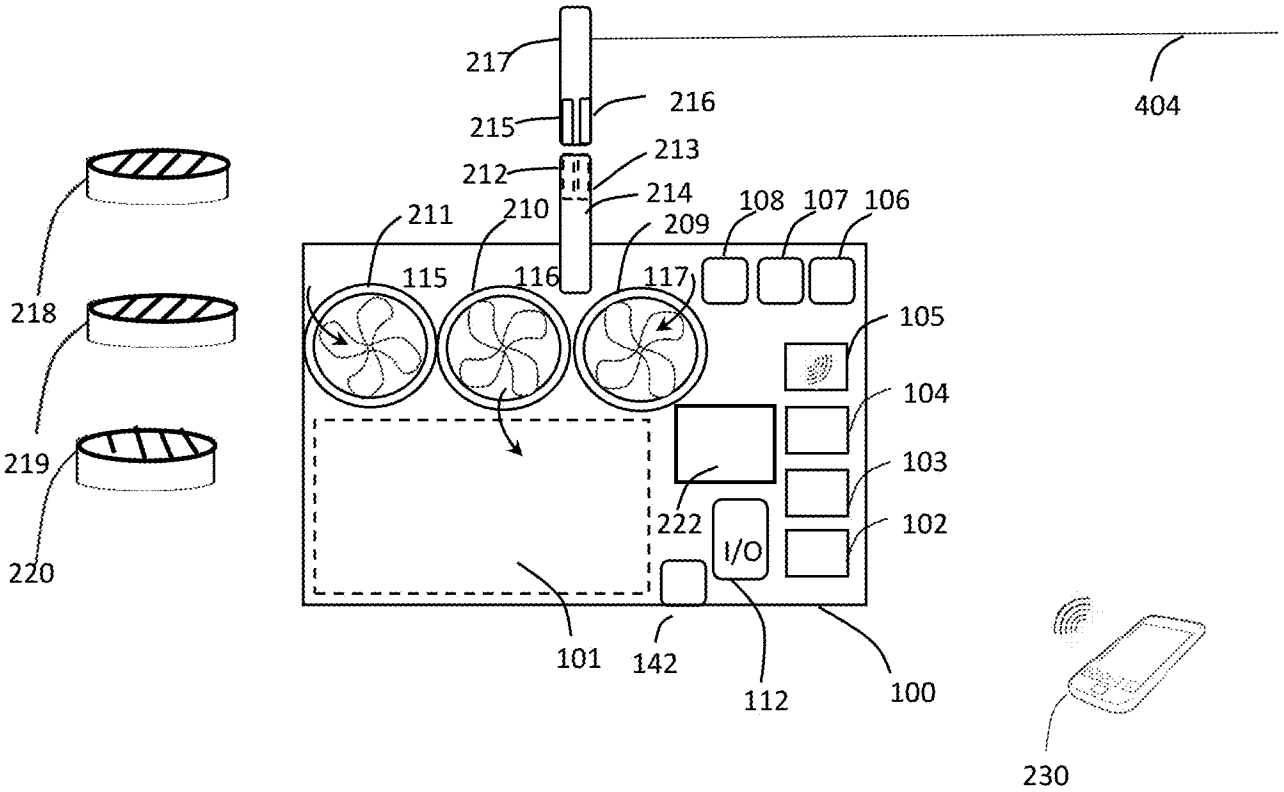
FIG. 2 illustrates a back view of a ventilation assembly panel, according to one embodiment of the present invention.

FIG. 2 represents the inside part of ventilation assembly panel 100. The person skilled in the art will understand that in some embodiments, Fans 115, 116, and 117 could be close enough such that fan 115 and Fan 117 that can be dedicated to extract air from the inside of the garage or enclosed space and Fan 116 that can be dedicated to sucking air into the garage or enclosed space from the outside may interfere with each other's operation. For example, the air that is extracted by Fan 115 And 117 could be the same that sucked in by Fan 116. Air Ducts 218, 219, and 220 having obliquus grates are capable of deflecting the flux of air that is extracted or sucked in into the garage. In one implementation they can be secured at Rims 211, 210, 209 and positioned, e.g., such that Fan 116 sucks in air and pushes it downward while Fans 115 and 117 extract hot air from above. In FIGS. 1 and 2 the arrows in proximity of the fans indicate the flow of air according to the above description.

In one implementation, the Standardized Ventilation Assembly Panel 100 will be completely self-sufficient via the energy provided by Solar Panel 101. In another implementation, Standardized Ventilation Assembly Panel 100 may receive electrical energy from the motor unit of the garage door. In another implementation, the Ventilation Assembly Panel 100, may be provided with probe 214. In one implementation, Probe 214, may be provided with Electrical Brushes 212 And 213. Attached to the wall, or to the garage door frame, there could be Probe 217, provided with Electrical Brushes 215 and 216, such that when the garage door is completely closed, Brush 215 And Brush 212 will be in contact. Equivalently when the garage door is completely closed Brush 216 and Brush 213 will be in contact. In one implementation, Probe 217 may be connected to the electric grid of the House so that when the garage door is completely closed, the Home Electric Grid via Cable Leg 404 will electrify Standardized Ventilation Assembly Panel 100. In one implementation the electrical brushes will be enclosed by a plastic enclosure so that they are not subject to the possibility of being dangerously touched by users. In one implementation Probes 217 and 214 are flexible and angled with respect to each other so that when they slide together the corresponding brushes will apply some degree of pressure to each other.

The energy to run the Standardized Ventilation Assembly Panel 100 and its components may come from the electric grid, a plug, or from an electric motor affixed to the ceiling that opens and closes the garage door. In one implementation, Smartphone 230 runs a mobile application controlling some of the functionalities of Standardized Ventilation Assembly Panel 100. Said mobile application could be monitoring some of the parameters that are measured by the sensors associated with the Standardized Ventilation Assembly Panel 100. Said mobile application could also be receiving alerts when thresholds pertaining to said parameters are exceeded.

The person skilled in the art will understand that Memory 104 may contain various algorithms that can be activated by a user via the Input/Output module 112 or Smartphone 230 and executed by CPU 103. In one simple implementation, if CO & Smoke Sensor 106, Temperature Sensor 107, Humidity Sensor 108, detect values that are below or above a predetermined threshold, an algorithm may activate one or more Fans to push air in or out of the garage according to a predetermined sequence.

For example, if the Temperature Sensor 107 detects an indoor temperature level above 100 Fahrenheit, the algorithm may activate Fan 115 and Fan 117 to push indoor air out of the garage, while Fan 116 will push outdoor air into the garage. Input/Output module 112, Memory 104, and CPU 103 may function as a thermostat trying to keep the temperature of the garage below 100 Fahrenheit if the outside temperature is below 100 Fahrenheit.

In one implementation the rotation of the fans will be fixed, either clockwise or anticlockwise. In another implementation, the rotation of the fans can be reversible. Fans will be able to rotate both clockwise and anticlockwise. In one implementation, the algorithm may consider multiple readings of the sensors. It can use CO and smoke detector data, humidity data and temperature data and be programmed to optimize the outcome. For example, an indoor reading of a high level of CO and Smoke data may trigger all Fans to extract air from the garage. A high level of humidity may trigger all fans to push hot air into the garage to avoid the creation of mold. Multiple readings of multiple sensors combined may trigger alarms or actions that can be preprogrammed.

In some implementations, the Wireless Module 105 may enable the operation of the Standardized Ventilation Assembly Panel 100 via a mobile application in a Smartphone 230 or its integration into system such as Google Home or Alexa Smart Home. The mobile application can be used to monitor the various functionalities and activate the fans or Light 140 remotely. As will be discussed with reference to FIG. 5, the Standardized Ventilation Assembly Panel 100 can be used as an integral part of the smart Home System. It can be integrated into the fire detection system. It can also be integrated into the home intrusion system by adding accelerometers or motion sensors that can detect the opening of the garage door when the motor unit has not been activated.

In some implementations. Wireless Module 105 may connect to a Wi-Fi controlled hub for daily, weekly, monthly trending of operation via a smart phone application to monitor the device usage for peaks for energy, and air quality reports.

Figure 3:
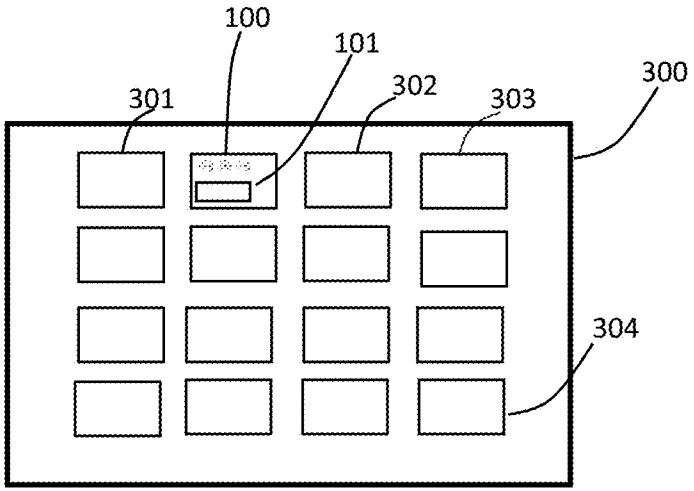
FIG. 3 illustrates a multi-panel retractable garage door wherein a standardized ventilation assembly panel has been installed in lieu of a standardized panel of the multi-panel retractable garage door, according to one embodiment of the present invention.

FIG. 3 illustrates a Multi-Panel Retractable Garage Door 300 wherein a Standardized Ventilation Assembly Panel 100 has been installed in lieu of a standardized panel of the multi-panel retractable garage door, according to one embodiment of the present invention. The person skilled in the art will understand that in some multi-panel retractable garage doors the user will have the possibility to choose where he will be able to install a Standardized Ventilation Assembly Panel 100. For example, he may be able to use any of the Standardized Panels 301, 302, 303. In some implementations, a user might be able to install multiple Standardized Ventilation Assembly Panels 100 in the same multi-panel retractable garage door. For example. Panel 304 can be substituted to host another Standardized Ventilation Assembly Panel 520 to exhaust the smoke generated by Electric Generator 505 and to inject the necessary air into said Electric Generator 505 as it will be explained with reference to FIG. 5.

Figure 4:
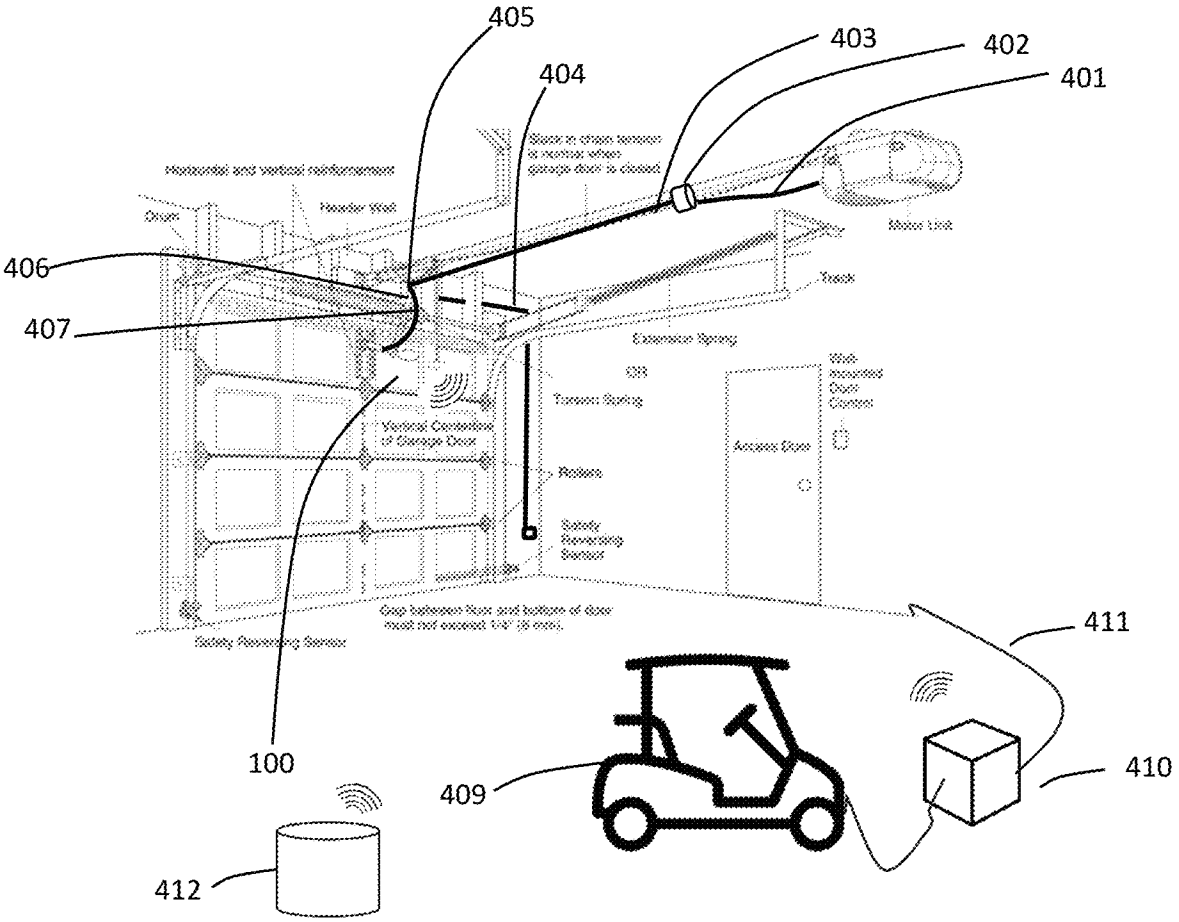
FIG. 4 illustrates a rear perspective view of a garage door ventilation assembly installed in a multi-panel retractable garage door together with one embodiment of the present invention.

FIG. 4 provides an exemplary implementation to supply electricity to the Standardized Ventilation Assembly Panel 100. In one implementation, Cable Leg 401 will be connected to the motor unit and to the Winding Module 402. The Motor Unit will provide electricity to the Standardized Ventilation Assembly Panel 100 or 520. Said Winding Module 402 will keep Cable Leg 403 in tension by means of an internal spring that will wind up any slack of Cable Leg 403 during the operation of the garage and will keep it always under tension. Winding Module 402 can be positioned on the motor unit or on the rail in a way not to interfere with the operation of the garage door or the moving chain. Cable Leg 403 will be attached to Anchor 405 on the curved arm door and to Cable Leg 407 that will provide electricity to the Standardized Ventilation Assembly Panel 100.

In another implementation, Cable Leg 404 will be connected to the home electric grid and can be positioned around the garage door frame while not interfering with the operations of the springs or the garage door. Cable Leg 404 might be connected to Probe 217 so that when the garage door is closed Probe 217 will be conjoined to Probe 214 and Battery 102 will be charged by the home electric grid. In this configuration, Fans 115, 116, 117 can be powered directly by the home electric grid.

It is known in the industry of electric carts and electric cars that the charging of batteries can produce hydrogen. Golf cart batteries, especially older ones, emit hydrogen, an odorless, colorless gas that is highly flammable. The production of hydrogen may occur during the charging of the batteries. In one implementation, when Golf Cart 409 is charged by Charger 410 then Charger 410 will communicate wirelessly or via other means such as cable the status of Charger 410 to Standardized Ventilation Assembly Panel 100. In some implementations, a charging status signaled by Charger 410 may trigger Standardized Ventilation Assembly Panel 100 to start the extraction of air and any other gas such as hydrogen from the enclosed space. In some implementations. Charger 410 is connected to the electric grid via Cable 411 and could be a smart charger that will start charging when the detected voltage of the batteries in the golf cart is below a triggering threshold. In some implementations, every time Charger 410 kicks in with the charging functionality, Standardized Ventilation Assembly Panel 100 may start the extraction of air automatically.

In some implementations, a Carbon Dioxide Fire Suppression System 412 can protect the enclosed area. CO2 flooding systems generally require a concentration of 34% of CO2 to extinguish a normal fire. If the Carbon Dioxide Fire Suppression System 412 is triggered by the detection of fire, the Standardized Ventilation Assembly Panel 100 may start the extraction of fumes and CO2 automatically after the CO2 has been released and absence of flames has been determined by the sensors within the enclosed area.

Figure 5:
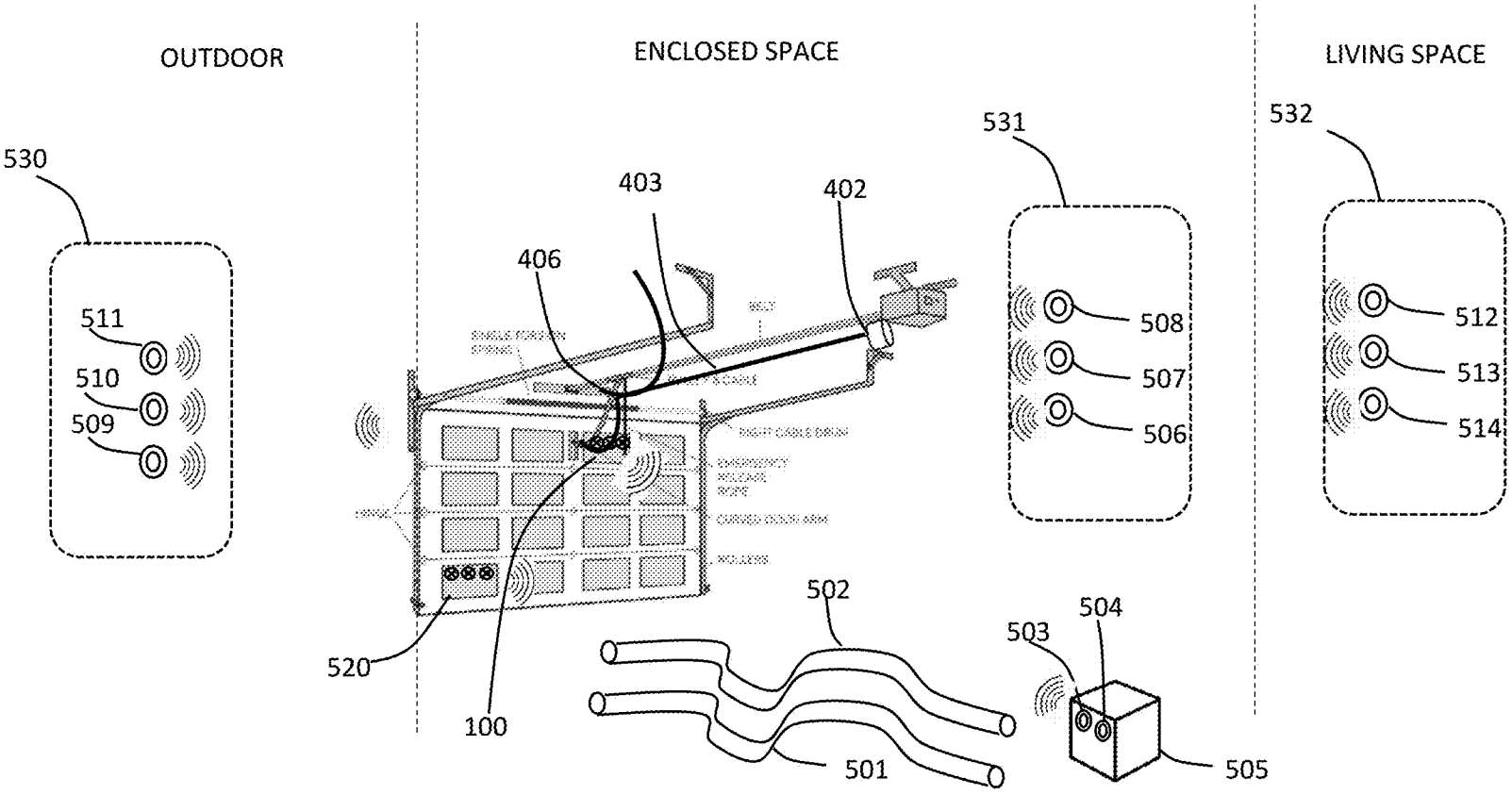
FIG. 5 illustrates a rear perspective view of a garage door ventilation assembly installed in a multi-panel retractable garage door together with another embodiment of the present invention; the dotted line represents the separation between the outside environment and the inside of the enclosed environment.

FIG. 5 describes another implementation, in which Winding Module 402 is attached to the motor unit and connected to the motor unit to provide electric power to the Standardized Ventilation Assembly Panel 100. Cable Leg 403 will be maintained strained by the continuous pull of the winding spring contained into the Winding Module 402 whose task is to eliminate any slack.

In one implementation Outdoor Wireless Sensors 511, 510 And 509 are placed outside the garage, or more generally the enclosed space, while Indoor Wireless Sensors 508, 507 and 506 are placed inside the garage. The person skilled in the art will understand that more sensors can be added. In one implementation, Memory 104 will contain an algorithm that may use the readings of those sensors to control the operation of Fan 115, 116, 117 based on differential values and an optimal value for a certain parameter. As a matter of example, Wireless Sensors 511 and 508 are paired and measure the temperature inside and outside the garage. In one implementation. Smartphone 230 runs a mobile application controlling the functionalities of Standardized Ventilation Assembly Panel 100. A preferred temperature can be set both via Smartphone 230 and/or I/O Module 112.

As a matter of example, the preferred temperature inside the garage is set to 80 Fahrenheit. In this first example, Wireless Sensor 511 is dedicated to temperature readings outside the garage and reads an outside temperature of 95 Fahrenheit. Wireless Sensor 508 is dedicated to temperature readings inside the garage or enclosed space and reads an inside temperature of 110 Fahrenheit. The difference between the ideal temperature and the temperature reading outside is 15. The difference between the ideal temperature and the temperature reading inside is 20. Since 95 is closer to 80 than 110, it is advantageous to move air from outside to the inside to equalize the inside temperature to the outside temperature and push hot air outside since the outside temperature is closer to the ideal benchmark temperature.

In a second example, Wireless Sensor 511 is dedicated to temperature readings outside the garage and reads an outside temperature of 60 Fahrenheit. Wireless Sensor 508 is dedicated to temperature readings inside the garage or enclosed space and reads an inside temperature of 90 Fahrenheit. The difference between the ideal benchmark temperature and the temperature reading outside is 20. The difference between the ideal temperature and the temperature reading inside is 10. Since the number 90 is closer to 80 than the number 60 is closer to 80, it is advantageous to prevent warm air from escaping from the garage or to prevent cold air to enter the garage. In some implementations an electronic movable cover may prevent the exchange of air between the garage and the outside environment. The person skilled in the art will understand that outside sensors 511, 510, 509 and inside sensors 508, 507, 506 may measure different parameters such as, e.g., air temperature, pressure, ozone (03), carbon monoxide (CO), carbon dioxide (CO2), relative humidity, and fine particulate matter (PM).

The person skilled in the art of creating useful algorithms will understand that some parameters will have optimal values of zero. For example, CO is a poisonous gas, and any concentration might be dangerous, so the optimal value could be zero or as low as possible. Other parameters such as temperature or humidity may have a preferred value. Furthermore, there could be a hierarchy between parameters such that the optimization of one parameter could be more important than the optimization of another parameters. For example, maintaining the levels of CO as low as possible inside the garage might be more important than optimizing the levels of relative humidity inside the garage. Thereto a hierarchy between all the parameters that the sensors can measure may regulate the operation of the fans or other hardware contained in Standardized Ventilation Assembly Panel 100 or other associated hardware. Those parameters that matter more than others will be kept within safe limits. Parameters that are connected to safety. e.g., could be labeled as having a higher status as compared to parameters connected to well-being.

The person skilled in the art will understand that air temperature, pressure, ozone (O3), carbon monoxide (CO), carbon dioxide (CO2), relative humidity. Hydrogen, and fine particulate matter (PM) sensors may be contained into single units or Wireless Stations 530, 531, 532 where one could be positioned inside a garage or enclosed space (Wireless Station 531), the other one could be positioned outdoor (Wireless Station 530) and one could be positioned inside a living area (Wireless Station 532).

In some implementations, a Standardized Ventilation Assembly Panel 304 can be paired with electric Generator 505. The person skilled in the art will know that electric generators run a combustion engine. A combustion engine contained in an Electric Generator 505 needs an Air Intake 503 and an Exhaust Escape 504 to operate. Traditionally, electric generators do not operate inside a garage but outside because the exhaust gas would render the garage's enclosed environment poisonous after a while. Electric generators are usually operated outside the house and need a long cord to reach the power transfer system which is traditionally located inside the garage. Additionally, during inclement weather, the operator of the generator would need to go outside to attend the generator periodically.

In one implementation, Conduit 502 can attach to Rim 210 and Air Intake 503. Fan 116 will suck in air from the outside environment to provide the needed oxygen for the combustion of the electric generator. On the other hand, Conduit 501 can attach to rim 211 and Exhaust Escape 504. Fan 115 will expel the fumes produced by the engine to the outside environment. Air Ducts 218, 219 may operate such that the air that is sucked into the generator engine is not mixed with the fumes that are expelled by diverting the air flows that are created by the running fans.

In one implementation a Supplemental Battery 222 may store the excess electric power produced by Solar Panel 101 or transported via Probe 214 to be used in instances when the main electric grid is off, such as during a black out for example.

A Wireless Module 105 may allow communication between Electric Generator 505 and Standardized Ventilation Assembly Panel 100 and/or Standardized Ventilation Assembly Panel 520, that can be identical to Standardized Ventilation Assembly Panel 100 and positioned in a different part of the garage door. The person skilled in the art will understand that multiple standardized ventilation assembly panels may communicate with each other and also with various sensors and appliances such as Electric Generator 505.

In one implementation Sensors 508, 507, 506 and Sensors 511, 510, 509 and Sensors 512, 513, 514 will monitor the garage indoor environment, the exterior of the garage, and the interior of the home for concentrations of poisonous gases or other parameters and may communicate those readings to Standardized Ventilation Assembly Panel 100 and/or Standardized Ventilation Assembly Panel 520. Those readings may control the flow of air via Fan 116 to the Air Intake 503, or the exhaustion of pollutant coming out the Exhaust Escape 504 via Fan 115.

A smart algorithm embedded in Memory 104 may continuously monitor air parameters inside and outside the garage and feed those parameters to Electric Generator 505 so that in case of any danger to be avoided or optimizations needed Electric Generator 505 can be controlled or even shut down. In some implementations. Electric Generator 505 will have its own sensors and may shut down without the need of any input from Standardized Ventilation Assembly Panel 100 and/or Standardized Ventilation Assembly Panel 520.

Figure 6:
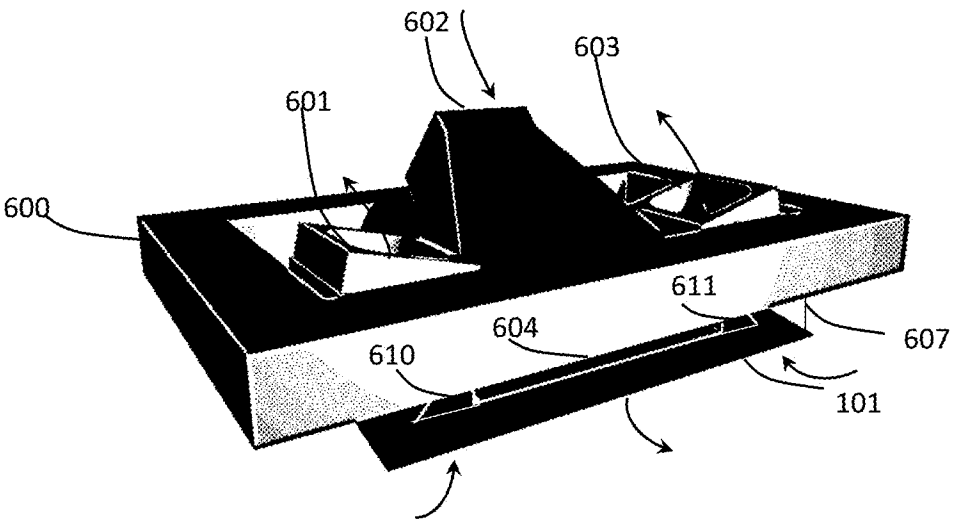
FIG. 6 provides an illustration of an embodiment of the present invention. An encased standardized ventilation assembly panel is represented with the back of the panel, namely the portion that should be into the inside of the enclosed environment such as a garage, facing up.

FIG. 6 provides an illustration of an embodiment of the present invention. Encased Standardized Ventilation Assembly Panel 600 is represented having the back of the panel, namely the portion that should be into the inside of the garage, facing up. Air Ducts 601, 602, 603, 610, 611 are molded into Encased Standardized Ventilation Assembly Panel 600 and they direct the intake or expulsion of air at different directions. In this implementation, Solar Panel 101 completely covers the fans and is positioned at a Distance 607 from the main structure such that it leaves a gap for Air Ducts 604, 610, 611 to intake or expel air from the garage. In FIG. 6 the direction of the arrows indicates how the air is moving in this embodiment. For example, hot hair is sucked in by Duct 602 from the top (since hot air is lighter) and expelled downward outside by Duct 604. Cold air is sucked in by Ducts 610 and 611 facing downward (since cold air is heavier) form outside and pushed in into Ducts 601 and 603.

The person skilled in the art understands that this embodiment allows the usage of large solar panels that may render the Encased Standardized Ventilation Assembly Panel 600 completely autonomous as concerns power, storing the excess energy produced during the day into Battery 102 or Supplemental Battery 222.

The person skilled in the art will also understand that although many examples refer to a garage door, the invention has a general applicability. Smart panels as the ones described in this application can be mounted in different configurations on walls and doors of a variety of enclosed spaces hosting humans, animals, or equipment. Since garage door panels are not officially standardized the present invention is independent from a predefined size or shape.

Many accessories can also be combined with the main functionalities of the panel. For example, the unit can be connected to speakers to allow communication with the household or intruders in the enclosed space.

Embodiments of the present invention can be implemented in software, hardware, application logic, or a combination of software, hardware, and application logic. The software, application logic, and/or hardware may reside on mobile computer equipment, fixed equipment, or servers.

In an example embodiment, the application logic, software, or an instruction set is maintained on any one of various conventional computer-readable media. In the context of this application, a "computer-readable medium" may be any media or means that can contain, store, communicate, propagate, or transport the instructions for use by or in connection with an instruction execution system, apparatus, or device, such as a computer or minicomputer.

A computer-readable medium may comprise a computer-readable storage medium that may be any media or means that can contain or store the instructions for use by or in connection with an instruction execution system, apparatus, or device.

If desired, the different functions discussed herein may be performed in a different order and/or concurrently with each other. Furthermore, if desired, one or more of the above-described functions may be optional or can be combined. As technology advances, new equipment and techniques can be viable substitutes for the equipment and techniques that have been described in this application.

For the purposes of the present application, a "plurality" means one or more.

Although various aspects of the invention will be set out in the independent claims, other aspects of the invention comprise other combinations of features from the described embodiments and/or the dependent claims with the features of the independent claims, and not solely the combinations explicitly set out in the claims. The above-described exemplary embodiments of the invention should not be viewed as limiting but merely as exemplary and explanatory.

The person skilled in the art will understand that are several variations and modifications, which can be made without departing from the scope of the present invention, as will be defined in the claims.

What is claimed is:

1. A system for an enclosed space comprising:

a panel capable of being operably mounted on a vertical plane confining said enclosed space, said panel comprising:

a memory module storing at least an optimal temperature data for said enclosed space;

a plurality of fans mounted on said panel and capable of drawing air into said enclosed space and expelling air outward from said enclosed space via a plurality of air ducts molded into said panel and configured to direct intake and expulsion of air in different directions, including drawing air from a top region of said enclosed space;

a solar panel power supply being operationally coupled to said panel;

a communication module mounted on said panel and capable of receiving data;

a first ambient sensor for measuring ambient data positioned outdoors and capable of measuring at least one of a temperature data, a humidity data, a CO data, a fumes concentration data, a CO2 data, a Hydrogen data, and an air pressure data;

a second ambient sensor for measuring ambient data positioned inside said enclosed space and capable of measuring at least one of a temperature data, a humidity data, a CO data, a fumes concentration data, a CO2 data, a Hydrogen data, and an air pressure data;

a control module being operationally coupled to said plurality of fans causing execution of at least one of selectively turning on said plurality of fans, selectively turning off said plurality of fans, selectively directing said plurality of fans to rotate clockwise, selectively directing said plurality of fans to rotate counter-clockwise, selectively drawing air into said enclosed space, and selectively expelling air outward from said enclosed space; wherein said control module causes said execution based on a differential temperature reading between a temperature data that is received from said first ambient sensor positioned outdoors as compared to said optimal temperature data, where the difference is D1 and a differential temperature reading between a temperature data that is received from said second ambient sensor positioned inside said enclosed space as compared to said optimal temperature data, where the difference is D2;

wherein said execution includes selectively controlling a direction of airflow produced by at least one of said plurality of fans to either (i) draw air into said enclosed space or (ii) expel air outward from said enclosed space such that D1 is equal or greater than D2.

2. The system as in claim 1, wherein said solar panel power supply being operationally coupled to said panel, acts as a movable cover capable of preventing the escape of air from said enclosed space.

3. The system as in claim 1, wherein said vertical plane confining said enclosed space is a garage door and said system is further including a probe that is operationally mounted on said panel such that when said door is in a closed position said system is connected to an electric grid.

4. The system as in claim 1, wherein said ambient data that are measured by said first ambient sensor and said second ambient sensor are classified according to a hierarchy such that differential readings between corresponding ambient data that are received from said first ambient sensor and said second ambient sensor have weights regulating execution of functionalities.

5. The system as in claim 1, wherein said control module causes extraction of air from said enclosed environment after said communication module has received data from a fire extinguishing system indicating that said enclosed space is saturated above a set threshold with at least one of CO2, and CO.

6. The system as in claim 1, wherein said communication module exchanges data with a second system such that said second system's plurality of fans operate to attain D1 equal or greater than D2.

7. The system as in claim 1, wherein at least one of said plurality of fans mounted on said panel is connected to at least one conduit that is operably attached to an electric generator to provide at least one of an extraction of combustion fumes produced by said electric generator, and an intake of air from outdoors to sustain the operation of said electric generator.

8. An apparatus comprising:

at least one processor; and at least one non-transitory computer-readable medium including a computer program code; the at least one non-transitory computer-readable medium storing an optimal temperature data and the computer program code configured to, with the at least one processor, cause the apparatus to perform at least the following:

control a plurality of fans mounted on a panel and capable of drawing air into an enclosed space, and expelling air outward from said enclosed space via a plurality of air ducts molded into said panel and configured to direct intake and expulsion of air in different directions, including drawing air from a top region of said enclosed space;

monitor a solar panel power supply being operationally coupled to said panel;

operate a communication module mounted on said panel and capable of receiving data;

receive data from a first ambient sensor for measuring ambient data positioned outdoors and capable of measuring at least one of a temperature data, a humidity data, a CO data, a smoke data, a CO2 data, a Hydrogen data, and air pressure data;

receive data from a second ambient sensor for measuring ambient data positioned inside said enclosed space and capable of measuring at least one of a temperature data, a humidity data, a CO data, a smoke data, a CO2 data, a Hydrogen data, and air pressure data;

cause execution of at least one of selectively turning said plurality of fans on, selectively turning said plurality of fans off, selectively directing said plurality of fans to rotate clockwise, selectively directing said plurality of fans to rotate counter-clockwise, selectively drawing air into said enclosed space, and selectively expelling air outward from said enclosed space;

wherein said processor is causing said execution based on a differential temperature reading between a temperature data that is received from said first ambient sensor positioned outdoors as compared to said optimal temperature data, where the difference is D1 and a differential temperature reading between a temperature data that is received from said second ambient sensor positioned inside said enclosed space as compared to said optimal temperature data, where the difference is D2; wherein said execution includes selectively controlling a direction of airflow produced by at least one of said plurality of fans to either (i) draw air into said enclosed space or (ii) expel air outward from said enclosed space such that D1 is equal or greater than D2.

9. The apparatus of claim 8, wherein said communication module operably mounted on said panel communicates to an associated smartphone at least one of ambient data from said second ambient sensor, ambient data from said first ambient sensor, and status data pertaining to said plurality of fans mounted on said panel.

10. The apparatus of claim 8, wherein said communication module exchanges data with a second apparatus for operating a system and said second apparatus's plurality of fans operate such that D1 is equal or greater than D2.

11. The apparatus of claim 8, wherein said communication module mounted on said panel receives data from at least one of a battery charger system, a fire extinguishing system, an electric generator system, a second apparatus comprising a second plurality of fans.

12. The apparatus of claim 8, wherein a third ambient sensor for measuring ambient data is positioned inside a living space that is adjacent to said enclosed space and said third ambient sensor for measuring ambient data is capable of measuring at least one of a temperature data, a humidity data, a CO data, a smoke data, a CO2 data, a Hydrogen data, and air pressure data such that said control module causes said execution of at least one functionality according to data based on differential readings between corresponding ambient data that are received from at least two of said first ambient sensor, said second ambient sensor, and said third ambient sensor.

13. The apparatus of claim 8, further comprising at least one of a camera module, a lamp module, a motion sensor module, a loudspeaker module.

14. A method for operating an air monitoring system comprising:

controlling a plurality of fans mounted on a panel and capable of drawing air into an enclosed space and expelling air outward from said enclosed space via a plurality of air ducts molded into said panel and configured to direct intake and expulsion of air in different directions, including drawing air from a top region of said enclosed space, wherein a solar panel is operationally coupled to said panel and provides a power supply;

storing at least an optimal temperature data for said enclosed space;

receiving ambient data from a first ambient sensor that is positioned outdoors wherein said ambient data is at least one of a temperature data, a humidity data, a CO data, a fumes concentration data, a CO2 data, a Hydrogen data, and an air pressure data;

receiving ambient data from a second ambient sensor that is positioned within said enclosed space wherein said ambient data is at least one of a temperature data, a humidity data, a CO data, a fumes concentration data, a CO2 data, a Hydrogen data, and an air pressure data;

controlling said plurality of fans by causing execution of at least one of selectively turning on said plurality of fans, selectively turning off said plurality of fans, selectively directing said plurality of fans to rotate clockwise, selectively directing said plurality of fans to rotate counter-clockwise, selectively drawing air into said enclosed space, and selectively expelling air outward from said enclosed space; wherein a control module causes said execution based on a differential temperature reading between a temperature data that is received from said first ambient sensor positioned outdoors as compared to said optimal temperature data, where the difference is D1 and a differential temperature reading between a temperature data that is received from said second ambient sensor positioned inside said enclosed space as compared to said optimal temperature data, where the difference is D2;

and wherein said execution includes selectively controlling a direction of airflow produced by at least one of said plurality of fans to either (i) draw air into said enclosed space or (ii) expel air outward from said enclosed space such that D1 is equal or greater than D2.

15. The method of claim 14, further comprising exchanging data with a second panel such that D1 is equal or greater than D2.

16. The method of claim 14, wherein a third ambient sensor for measuring ambient data is positioned inside a living space that is adjacent to said enclosed space and said third ambient sensor for measuring ambient data is capable of measuring at least one of a temperature data, a humidity data, a CO data, a smoke data, a CO2 data, a Hydrogen data, and air pressure data such that said control module causes said execution of at least one functionality according to data based on differential readings between corresponding ambient data that are received from at least two of said first ambient sensor, said second ambient sensor, and said third ambient sensor.

17. The method of claim 14, wherein said solar panel operationally coupled to said panel acts as movable cover that is capable of preventing escape of air from said enclosed space.

18. The method of claim 14, wherein said panel is connected to an electric generator and expels its fumes.

19. The method of claim 14, wherein said system is monitored and controlled via a mobile application contained in a smartphone.

20. The method of claim 19, wherein said mobile application contained in a smartphone controls at least one of an opening functionality of said garage door, a closing functionality of said garage door.

* * * * *